United States Patent [19]

Levey

[11] 4,105,233

[45] Aug. 8, 1978

[54] WINDOW AND DOOR LOCK

[75] Inventor: Virginius T. Levey, Sacramento, Calif.

[73] Assignee: Ida M. Thompson, Sacramento, Calif.

[21] Appl. No.: 823,267

[22] Filed: Aug. 10, 1977

[51] Int. Cl.[2] ..... E05C 17/54

[52] U.S. Cl. ..... 292/288; 292/DIG. 46

[58] Field of Search ..... 292/262, 288, 300, 305, 292/306, DIG. 46

[56] References Cited

U.S. PATENT DOCUMENTS

| | | | |
|---|---|---|---|
| 1,838,713 | 12/1931 | Solomon | 292/305 X |
| 3,112,635 | 12/1963 | Van Harn et al. | 292/DIG. 46 |
| 3,975,041 | 8/1976 | Edison | 292/DIG. 46 |

*Primary Examiner*—Richard E. Moore

*Attorney, Agent, or Firm*—John N. Randolph

[57] ABSTRACT

A lock for closures, having horizontally sliding panels, such as doors or windows, which is so constructed that one or two horizontally slidable closures may be opened partially to provide ventillation but to an extent insufficient to afford ingress to an intruder.

5 Claims, 5 Drawing Figures

WINDOW AND DOOR LOCK

SUMMARY

It is a primary object of the present invention to provide a lock of extremely simple construction which may be readily mounted in the upper track of multiple horizontally sliding windows or doors to effectively function to restrict the extent that said closures can be opened.

Another object of the invention is to provide such a lock which may be readily unlocked from the inside to permit further opening of the sliding closures.

A further object of the invention is to provide a lock of the aforedescribed character which will additionally function to prevent removal of the sliding closures from their guide channels.

Another object of the invention is to provide a look which will require no modification of the closure to which it is applied and which can be applied or removed without the use of tools.

Various other objects and advantages of the invention will hereinafter become more fully apparent from the following description of the drawing, illustrating a presently preferred embodiment thereof, and wherein:

DESCRIPTION OF THE PREFERRED EMBODIMENT

Figure 1:
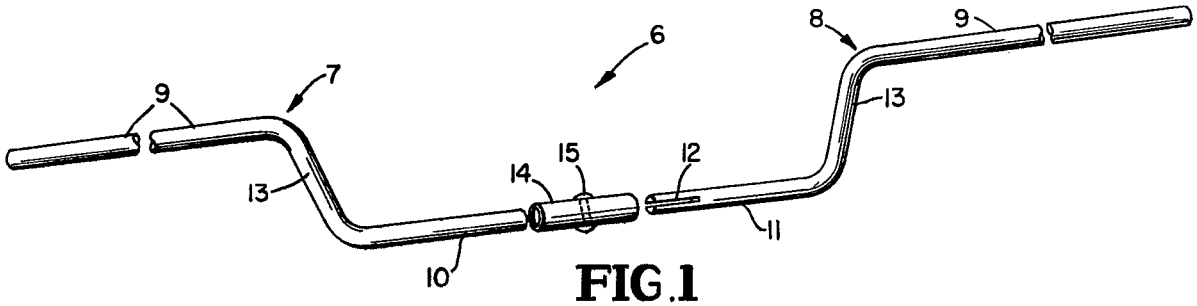
FIG. 1 is a fragmentary perspective view of the parts of the lock detached from one another.
Figure 2:
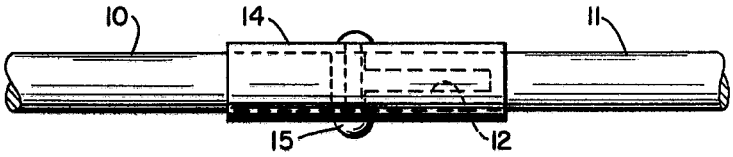
FIG. 2 is a side elevational view of the intermediate portion of the lock with the parts assembled.

Referring more specifically to the drawing, the window and door lock in its entirety and as illustrated in FIG. 1 is designated generally 6 and comprises two rods 7 and 8 each including a long outer end portion 9. The rod 7 has a shorter inner end portion 10 and the rod 8 has a shorter inner end portion 11, which differs from the end portion 10 only in that its inner end is provided with an elongated outwardly opening slot 12. The rods 7 and 8 have intermediate portions 13 which are disposed at oblique angles to the end portions. The adjacent ends of the inner rod portions 10 and 11 engage in the ends of a sleeve 14 which has a pin 15 extending transversely through an intermediate portion thereof and which is secured therein. The pin 15 is normally disposed in an upright position crosswise of the slot 12 to limit the extent that the adjacent ends of the rod portions 10 and 11 can be inserted into said sleeve.

Figure 4:
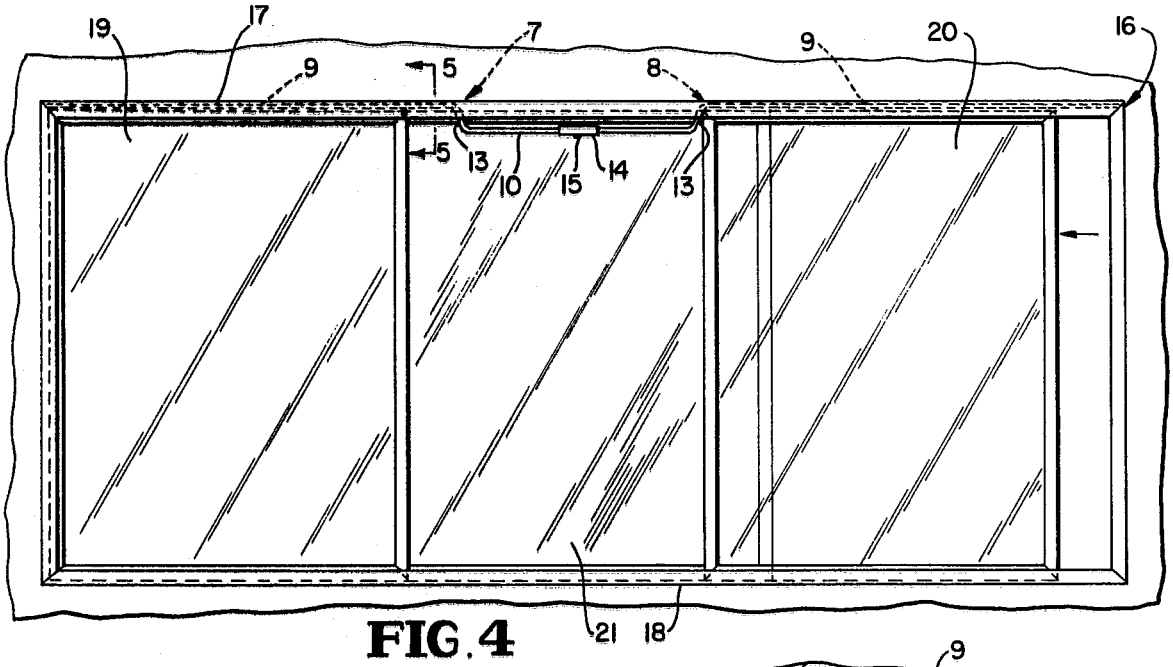
FIG. 4 is an elevational view looking toward the inner side of a window composed of a stationary intermediate panel and sliding end panels to which the lock is shown applied.
Figure 5:
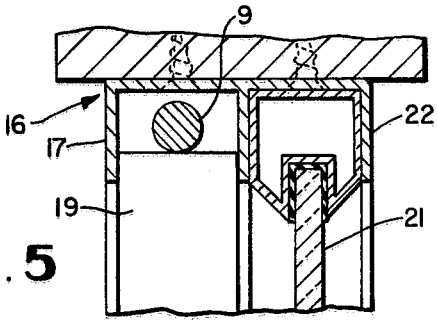
FIG. 5 is an enlarged fragmentary cross sectional view, taken substantially along a plane as indicated by the line 5—5 of FIG. 4.

FIG. 4 illustrates a conventional three panel window which includes a horizontally elongated rectangular frame 16 of inwardly opening channel-shape cross section, as seen in FIG. 5. The top portion 17 and the bottom portion 18 of the frame 16 constitute tracks in which upright window panels 19 and 20 are mounted for horizontal sliding movement.

A stationary window panel 21 is mounted on the outer side of the intermediate portion of frame 16 in a frame 22 which may be formed integral with the frame 16. Sufficient space is left between the upper edges of the window panels 19 and 20 and the top portion of the upper channel 17, so that said panels 19 and 20 can be lifted sufficiently to disengage their bottom portions from the bottom track 18, for removal of said panels from the frame 16.

With the windows 19 and 20 in closed positions and with the parts of the lock 6 disconnected, as seen in FIG. 1, the end 9 of the rod 7 is inserted between the upper edge of the window 19 and the top of the upper guide channel 17 and displaced outwardly until the outer extremity of the rod portion 9 abuts the end of the frame. The portion 9 of the rod 8 is similarly applied to the upper channel 17 above the window 20. The rod portions 9 are of a length such that when their extremities are abutting the ends of the frame 16, the oblique portions 13 of said rods will be spaced inwardly from the adjacent inner edges of the closed windows 19 and 20, preferably about seven inches. The rod portions 13 will be disposed in a vertical plane so that the rod portions 10 and 11 will be disposed below the level of the rod portions 9 and substantially parallel thereto. Rods 7 and 8 are of a length such that the adjacent ends of the rod portions 10 and 11 will be spaced slightly from one another, when in alignment.

Figure 3:
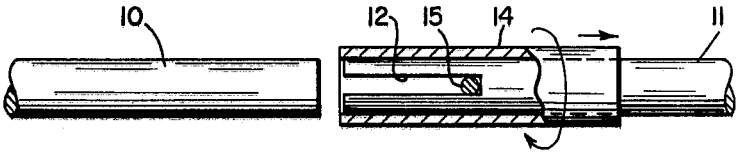
FIG. 3 is a side elevational view, partly in vertical section, showing said intermediate portion disconnected.

Rod portions 9 have a limited oscillating movement in the upper guide channel 17 so that the rod portions 10 and 11 can be moved out of alignment with one another, to enable the sleeve 14 to be slid over the rod portion 11 and turned to align the pin 15 with the slot 12 so that said pin can slide to the inner end of the slot, as seen in FIG. 3. Rods 7 and 8 are then released to cause rod portions 10 and 11 to resume positions in alignment with one another. Sleeve 14 is then slid onto rod portion 10 until the pin 15 strikes the terminal of said rod portion. The sleeve 14 is then rotated ninety degrees to position the pin 15 in an upright position and crosswise of the slot 12 for thus securing the lock in the window frame 16. It will be readily apparent that the windows 19 and 20 can slide inwardly in their guide channels 17 and 18, each a distance of about 7 inches to afford an opening in each end of the frame 16 to provide ventillation, but which is insufficient to permit ingress of an intruder.

The rod portions 9 will also provide obstructions to prevent the windows 19 and 20 from being lifted sufficiently in the frame 16 for removal of the windows from the frame.

Since the rod portions 10 and 11 are located on the inner side of the stationary window 21, said rod portions and the sleeve 14 are not accessible from the outside of the window, so that the lock 6 can be unlocked only from the inside of the window. This can be readily accomplished by turning sleeve 14 to align pin 15 with the slot 12, after which the sleeve is slid off of the rod portion 10 and to its position of FIG. 3 on the rod portion 11. Either rod portion 10 or 11 can be swung out of alignment with the other so that the rods 7 and 8 can be moved in opposite directions into partially overlapping relation, to allow the windows 19 and 20 to be moved to nearly fully opened positions.

Various modifications and changes are contemplated and may be resorted to, without departing from the function or scope of the invention.

I claim as my Invention:

1. In combination with a closure including a horizontally elongated upright rectangular frame of inwardly opening channel-shape cross section having upright closure panels mounted therein for horizontal sliding movement toward and away from one another and a stationary panel mounted on and secured to an outer side of said frame intermediate of its ends and combining with said sliding panels for completely closing the frame when the sliding panels are located in the ends of the frame; a lock for said sliding panels comprising two rods having corresponding outer end portions engaging in top portions of the frame and resting on upper edges of said sliding panels, said rod portions having outer ends abutting the ends of the frame and being of a length somewhat greater than the horizontal length of the sliding panels, said rods having downwardly extending intermediate portions and horizontally extending inner end portions, said inner end portions terminating in slightly spaced apart relation to one another, and means retaining said inner end portions in alignment with one another to prevent any appreciable sliding movement of the rods toward one another, said intermediate portions defining stops for limiting movement of said sliding closures toward one another.

2. A window or door lock as in claim 1, said means comprising a sleeve slidably engaging said inner rod portions.

3. A window or door lock as in claim 2, a pin extending transversely through an intermediate portion of the sleeve, one of said inner rod portions having a slot opening outwardly of its terminal to receive the pin when the sleeve is rotated to align the pin with said slot, said slot being of a length to permit the sleeve to be slidably disengaged from the other rod whereby said inner rod portions can be swung out of alignment with one another for sliding the rods into partial overlapping relation to permit the sliding panels to be moved to a more open position.

4. A window or door lock as in claim 1, said intermediate portions being disposed at oblique angles to the end portions of the rods.

5. A window or door lock as in claim 1, said outer end portions of the rods providing abutments to prevent the inner panels from being lifted in the frame and disengaged therefrom.

* * * * *